United States Patent [19]

Sugita

[11] 4,414,827

[45] Nov. 15, 1983

[54] COLLAPSIBLE KNITTING MACHINE

[75] Inventor: Yoshimori Sugita, Nagoya, Japan

[73] Assignee: Brother Kogyo Kabushiki Kaisha, Japan

[21] Appl. No.: 407,958

[22] Filed: Aug. 13, 1982

[30] Foreign Application Priority Data

Aug. 31, 1981 [JP] Japan ..... 56-137354

[51] Int. Cl.[3] ..... D04B 7/00

[52] U.S. Cl. ..... 66/60 H; 66/115

[58] Field of Search ..... 66/60 H, 60 R, 64, 115, 66/114

[56] References Cited

U.S. PATENT DOCUMENTS 3,124,946 3/1964 Hiromatsu ..... 66/60 H 4,327,564 5/1982 Kiuchi ..... 66/60 H

FOREIGN PATENT DOCUMENTS 36-26162 4/1961 Japan ..... 66/60 H

*Primary Examiner*—Ronald Feldbaum

*Attorney, Agent, or Firm*—Leydig, Voit, Osann, Mayer & Holt, Ltd.

[57] ABSTRACT

A collapsible flat bed knitting machine has a foldable needle bed having a multiplicity of sinker elements and latch needles. The needle bed is divided along its length three parts which we foldably connected together at the mutually opposite longitudinal end portions by improved connector units. Each of the connector units has a vertical axis which is disposed near the front edges of the sinker elements disposed at the end portions. One of the two mutually connected contiguous needle bed parts may be swung relative to the other needle bed part in a horizontal plane with the vertical axis as center and brought to the collapsed position in which the sinker elements of the needle bed parts are directly opposite to one another.

3 Claims, 5 Drawing Figures

COLLAPSIBLE KNITTING MACHINE

BACKGROUND OF THE INVENTION

This invention relates to a hand-operated home knitting machine and more particularly to a collapsible flat bed knitting machine in which the needle bed can be collapsed for facilitating transportation thereof.

In general, in a hand-operated home knitting machine, about 200 latch needles are juxtaposed on the needle bed at a constant pitch of about 4.5 mm. As a consequence, the needle bed may have an overall length in excess of 0.9 m thus causing difficulties in transportation of the hand knitting machine. Hence, collapsible flat bed knitting machines have been proposed in the art. In these conventional machines, the needle bed is divided into plural sections or parts which are connected together by hinge units that have horizontal axes parallel to the longitudinal direction of the latch needles. The respective needle bed parts may be turned about said horizontal axes and placed in vertically superposed relation to one another.

However, in such conventional hand knitting machine, the latch needles on the upper needle bed section are spaced apart from those on the lower needle bed section by distances larger than the needle pitch being equal to 4.5 mm. Thus the web mounted on the latch needles for knitting may be stretched when the needle bed is folded in the manner mentioned above, resulting in a warped or deformed fabric. Hence, the conventional machine of this type can be handled only with considerable difficulties because the web must be detached from the latch needles whenever the needle bed is collapsed for transporting the machine, and the web must be engaged again with the latch needles whenever the needle bed is straightened for restarting the knitting.

SUMMARY OF THE INVENTION

The present invention contemplates to obviate these drawbacks of the prior-art devices above mentioned and has it as an object to provide a hand knitting machine in which the handling can be simplified because the web mounted on the latch needles for knitting is not deformed when the needle bed is collapsed for transporting the machine and hence the web need not be detached from the latch needles in advance of folding of the needle bed.

According to a preferred embodiment of the present invention, the needle bed having a large number of sinker elements and latch needles is divided into three sections or parts which are foldably connected to one another at the confronting longitudinal edges by improved connector units. Each of such units has a vertical axis which is disposed near the front edges of the sinker elements. One of a pair of interconnected contiguous needle bed sections is rotated in a horizontal plane about said vertical axis and folded relative to the other with the sinker elements of said one section confronting to the sinker elements of said other section. Accordingly, the web is not deformed even in cases where the needle bed is collapsed with the web being mounted on the latch needles.

DETAILED DESCRIPTION OF THE PREFERRED EMBODIMENT

Figure 1:
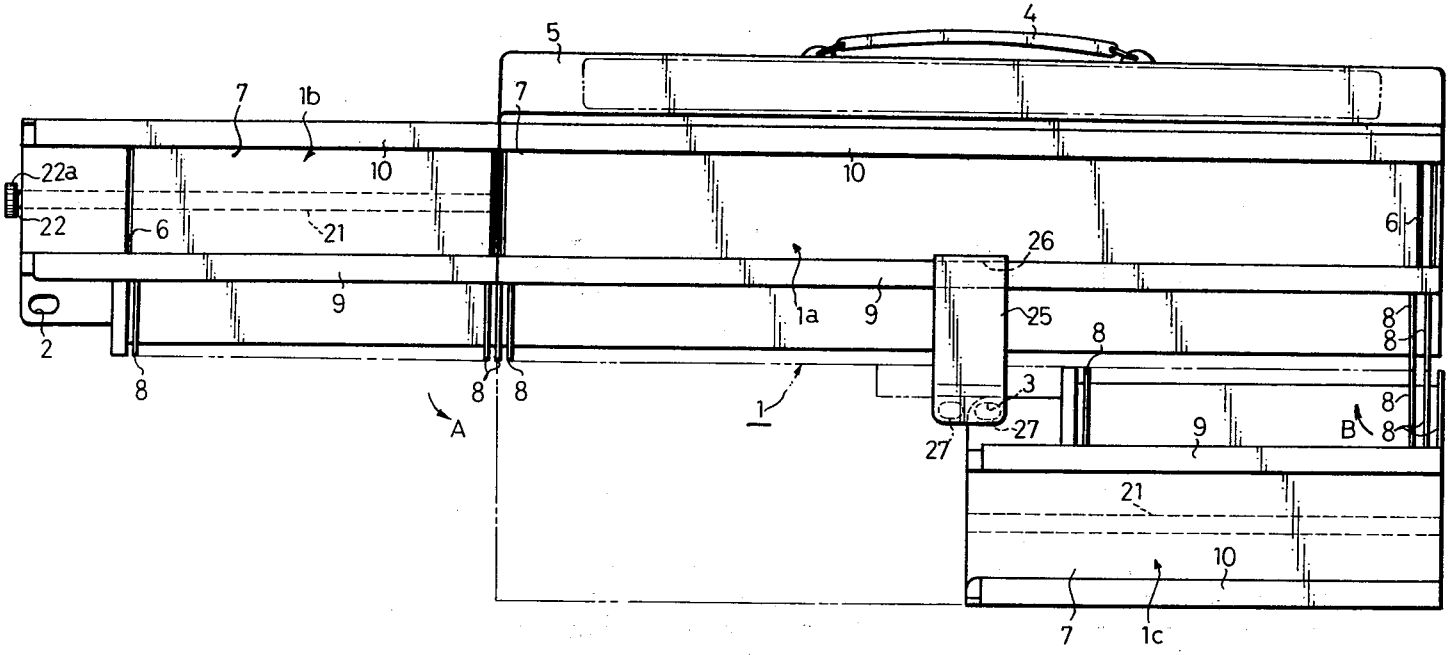
FIG. 1 is a plan view showing a collapsible knitting machine according to an embodiment of the present invention.
Figure 2:
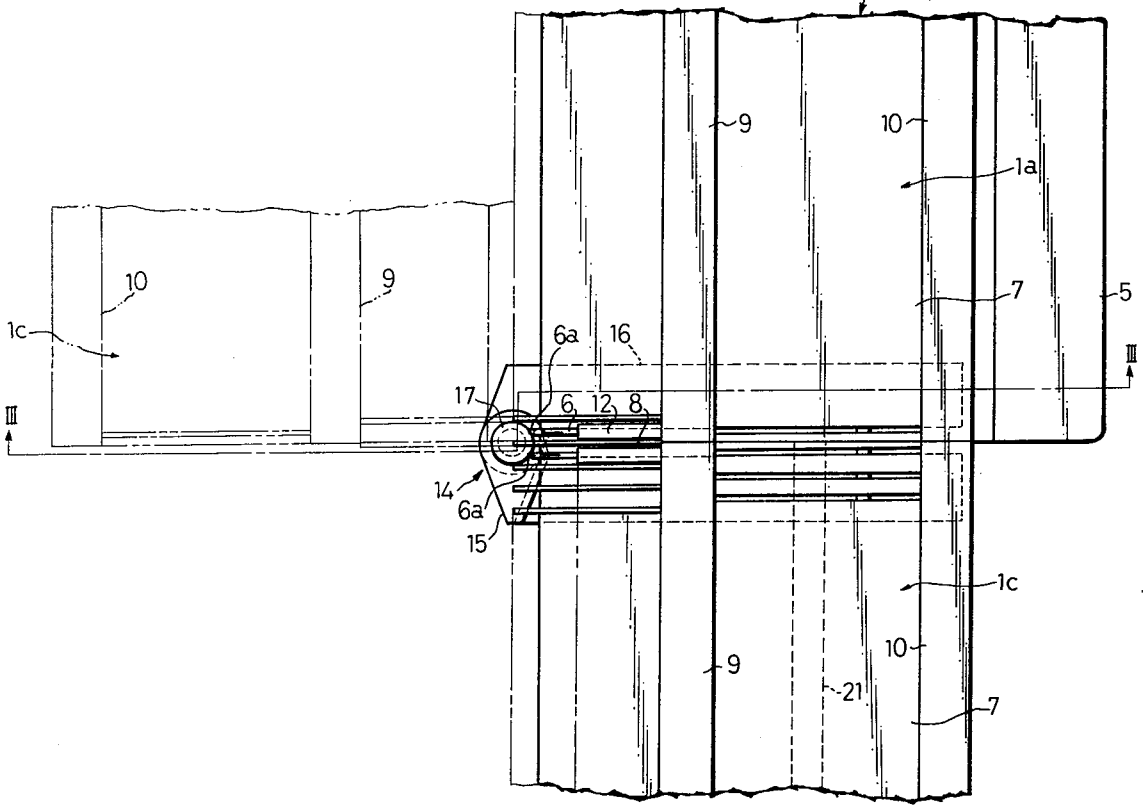
FIG. 2 is an enlarged plan view showing a portion of the knitting machine shown in FIG. 1.
Figure 3:
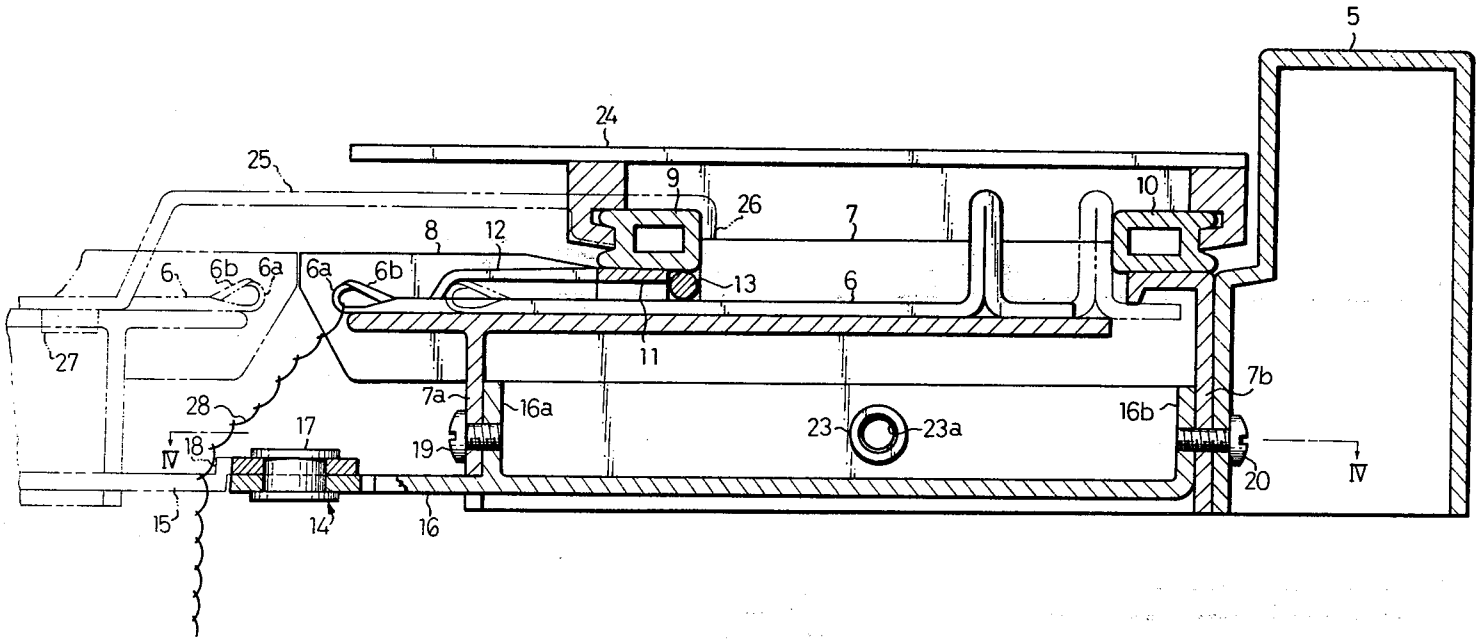
FIG. 3 is an enlarged sectional view taken along line III—III of FIG. 2.
Figure 4:
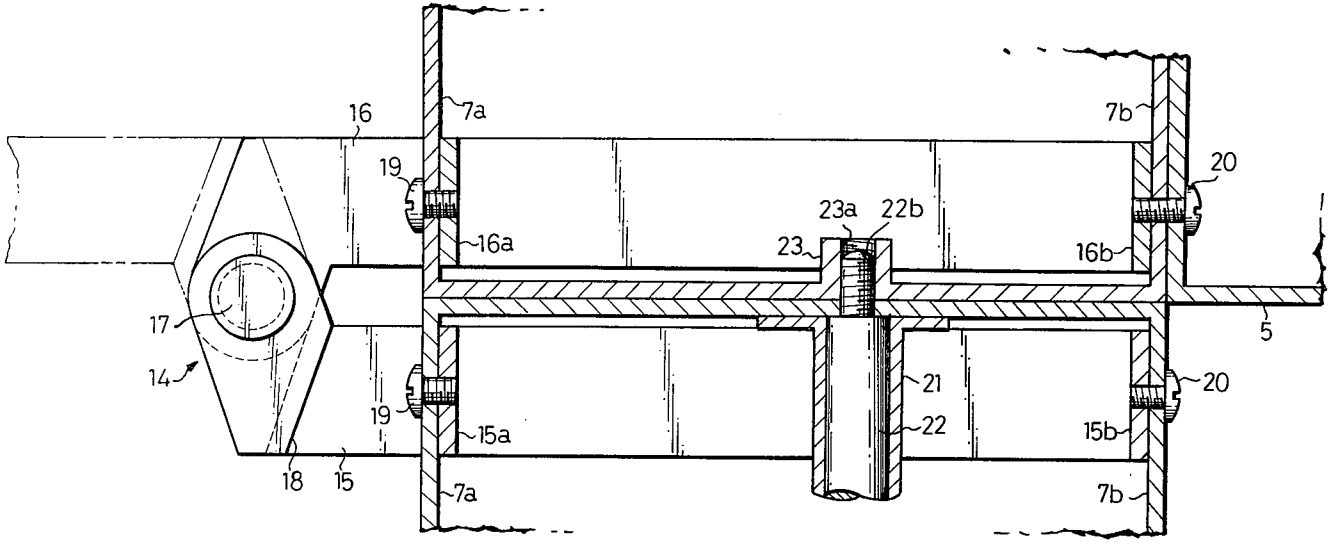
FIG. 4 is a sectional view taken along line IV—IV of FIG. 3.

FIGS. 1 to 4 illustrate a preferred embodiment of the present invention. A needle bed 1 is divided along its length into three sections or parts 1*a*, 1*b* and 1*c*, with the central major part 1*a* having a length equal to approximately one half overall length of the needle bed 1 and left and right minor parts 1*b*, 1*c* each having a length equal to one half the length of the central major part 1*a* or one fourth the overall length of the needle bed 1. A rear case 5 having a handle 4 to be used as an aid in transporting the knitting machine is mounted in the back part of the central major part 1*a*. Each of the parts 1*a* to 1*c* is made up of a needle guide portion 7 and a plurality of sinker elements 8 placed along the front edge of the needle guide portion 7 in alternate relationship with latch needles 6 mounted in turn at a constant pitch on said needle guide portion 7 and slidable in the fore and aft direction. A front rail member 9 and a rear rail member 10 are mounted on the upper surface of each needle guide portion 7 longitudinally of the needle bed 1. Each sinker element 8 is made of plastics and formed integrally with a strip 11 clamped between the rail member 9 and the needle guide portion 7. The strip 11 is also formed integrally with finger portions 12 extending forwardly and disposed in alternate relationship with the sinker elements 8. Each finger portion 12 has its foremost part resiliently and slidingly engaged with the latch needle 6. When the latch needle 6 is receded to its extreme rear position, the finger portion 12 overlies the hook 6*a* and the latch 6*b* of the needle 6. The numeral 13 designates a needle stopper in the form of a rod provided to the needle guide portion 7 below the rail member 9. The numeral 14 designates a pair of hinge units for connecting the central major part 1*a* to the left minor part 1*b* and the central major part 1*a* to the right minor part 1*c*. Each hinge unit 14 is formed by a first connecting member 15 and a second connecting member 16 pivotally connected to each other by a vertical axis 17. The connecting member 15 has a step shaped portion 18 in the neighborhood of the vertical axis 17 so that the connecting members 15, 16 may generally be included in the same horizontal plane. The connecting members 15, 16 are formed with upright portions 15*a*, 15*b* and 16*a*, 16*b* at predetermined intervals, while the needle guide portions 7 of the needle bed parts 1*a* to 1*c* are formed with depending wall portions 7*a*, 7*b*. In the neighborhood of the connecting portions between the parts 1*a* and 1*b* and between the parts 1*a* and 1*c*, the upright portions 15*a*, 16*a* are secured to the depending wall portion 7*a* with screws 19, whereas the upright portions 15*b*, 16*b* are secured to the depending wall portion 7*b* with screws 20. The rear case 5 is fastened to the central major part 1*a* with one of the screws 20 associated with the central major part 1*a*. The center of the vertical axis 17 of the hinge unit 14 is disposed directly below and slightly forwardly of the front edges of the sinker elements 8. The numeral 21 designates a pair of guide tubes mounted below the needle guide portions 7 of the left and right minor parts 1*b*, 1*c* for extending in the left and right direction. A straight bar 22 having a knob 22*a* at the base portion is mounted slidably and rotatably in each of the guide tubes 21. Each straight bar 22 is formed with a male screw 22*b* at the forward portion, whereas left and right end plates of the needle guide portion 7 of the central major part 1*a* are provided with tubular portions 23 each having a female screw 23*a* designed to mesh with the male screw 22*b* of the associated straight bar 22.

The connecting zone between the central part 1*a* and the left minor part 1*b* and the connecting zone between the central part 1*a* and the right minor part 1*c* are designed to be disposed between the end needles 6 of the needle bed parts 1*a* to 1*c*, and the sinker elements 8 disposed between these end needles 6 are provided to the minor needle bed parts 1*b*, 1*c*. The numeral 24 designates a carriage mounted over the rail members 9, 10, and the numeral 25 designates a holder made of resilient plastics and designed to hold the parts 1*b*, 1*c* in the collapsed position with respect to the central major part 1*a*. The holder has an engaging portion 26 at one end for receiving the rail member 9 and projections 27, 27 at the other for resiliently engaging with mating recesses in the needle bed parts 1*b*, 1*c*.

The operation of the present embodiment is as follows. When knitting a web 28 by use of the hand-operated knitting machine, the parts 1*a* to 1*c* are brought to an aligned position, and the knobs 22*a* are operated rotationally so that the male screw 22*b* of the straight bar 22 is threaded with the female screw 23*a* of the tubular portion 23. With the parts 1*b*, 1*c* thus locked relative to the central part 1*a* against rotation, the web 28 in knitted by operation of the carriage 24 in the known manner. When desired to transport the machine while the web 28 is still being knitted, the knobs 22*a* are rotated in the opposite direction to that described above, with the loops of the web 28 being mounted on the needles 6, for disengaging the male screws 22*b* of the straight bar 22 from the female screws 23*a* of the tubular portions 23. The needle bed parts 1*b*, 1*c* are then rotated about the axes 17 of the hinge units 14 in the directions shown by the arrow marks A and B, respectively. In this manner, the parts 1*b*, 1*c* may be swung in the horizontal plane and the sinker elements 8 of the parts 1*b*, 1*c* may be positioned directly in front of the sinker elements 8 of the central part 1*a* and the needles 6 of the parts 1*b*, 1*c* are disposed with their hooks 6*a* opposite to and at a close distance from the hooks 6*a* of the needles 6 of the central major part 1*a*. Thus the left minor part 1*b* is turned about the associated axis 17 with the hook 6*a* of the right-hand side end latch needle 6 thereof in close proximity to the hook 6*a* of the left-hand side end latch needle of the central major part 1*a*. In the similar manner, the right minor part 1*c* is turned about the associated axis 17 with the hook 6*a* of the left-hand side end latch needle 6 thereof in close proximity to the hook 6*a* of the right-hand side end latch needle 6 of the central major part 1*a*. Hence, even where the web 28 being knitted bridges over the connecting zone between the central part 1*a* and the left minor part 1*b* and/or the connecting zone between the central major part 1*a* and the right minor part 1*c*, that portion of the web 28 which is disposed at one or both of said connecting zone is not placed under tension to any degree as a result of rotation of the left and right minor parts 1*b*, 1*c*, and the needle bed 1 may thus be folded or collapsed without causing any deformation of the web 28.

With the needle bed 1 thus folded, the engaging portion 26 of the holder 25 is engaged with the central portion of the rail member 9 of the central major part 1*a*, while the end projections 27, 27 of the holder 25 are raised slightly against their own resiliency and engaged with the recesses 2, 3 of the needle bed parts 1*b*, 1*c* resiliently for securing the parts 1*b*, 1*c* to the central part 1*a* in parallel with one another. A casing, not shown, is applied to the thus folded needle bed 1 and the web 28 mounted on the needles 6 for transporting the machine.

Figure 5:
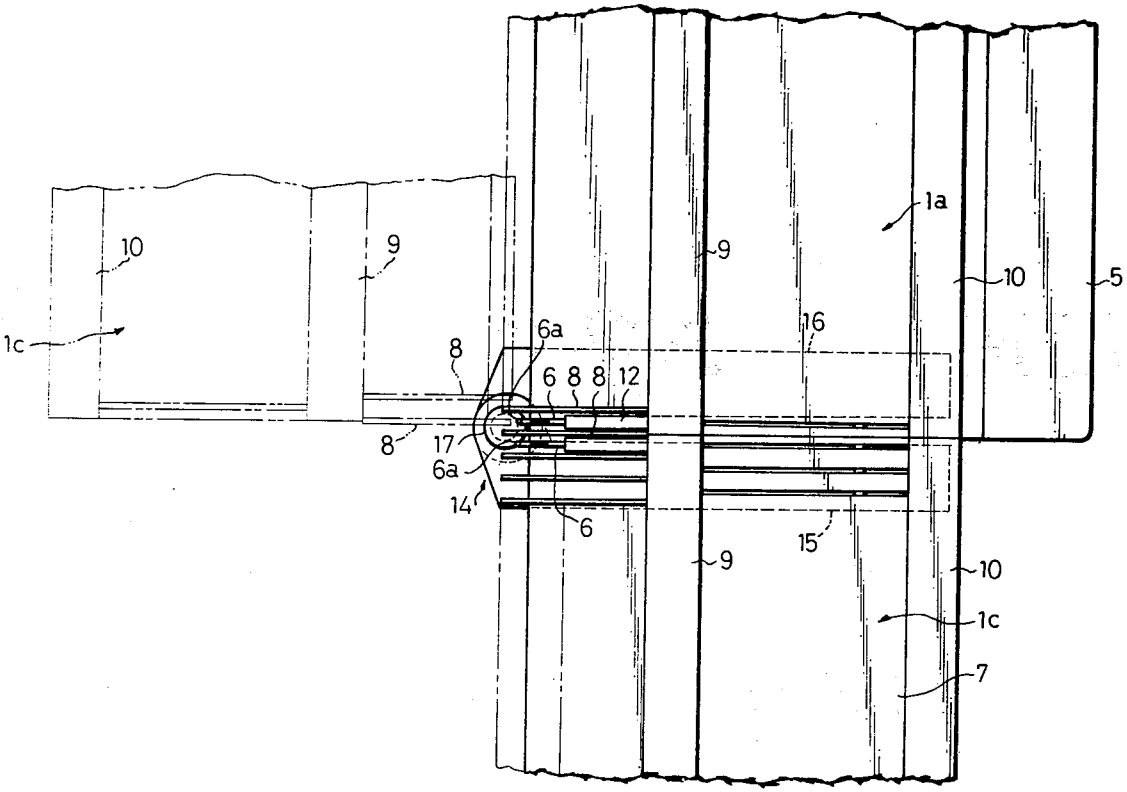
FIG. 5 is a partial plan view of the hand knitting machine according to a modified embodiment of the present invention.

In the above embodiment, the sinker elements 8 of the needle bed parts 1*b*, 1*c* are disposed directly opposite to the sinker elements 8 of the central major part 1*a* when the parts 1*b*, 1*c* have been folded onto the central major part 1*a*. However, as shown in FIG. 5, the sinker elements 8 of the needle bed parts 1*b*, 1*c* may be projected slightly between the adjoining front edges of the sinker elements 8 of the parts 1*b*, 1*c* when the parts 1*b*, 1*c* have been pivoted as described above.

According to the present invention, as mentioned in the above, the needle bed is divided along its length into plural sections or parts and connector means are provided for connecting them together in such a manner that the needle bed parts may be swung in a substantially horizontal plane about points close to the front edges of the sinker elements disposed at the connecting zones and may then be locked in a folded or collapsed position in which the sinker elements of the central part may be located directly opposite to the sinker elements of the left and right needle bed parts. Thus, even in cases where the web is mounted on the latch needles when the needle bed is brought to the folded or collapsed position for convenience in transportation of the knitting machine, the web is not deformed as a result of folding. Thus the troublesome operation of dismounting the web from the latch needles in advance of folding the needle bed may be completely avoided so that handling of the knitting machine may be facilitated considerably.

What is claimed is:

1. A collapsible flat bed knitting machine, comprising;

a needle bed including a major part and at least one minor part;

a plurality of sinker elements arranged in parallel with each other and at regular intervals on the front edge of said needle bed in the longitudinal direction thereof;

a plurality of latch needles aligned in a row in said needle bed and positioned alternately between said sinker elements;

said latch needles being slidable in a direction perpendicular to the longitudinal direction of said needle bed; and connector means for connecting said minor part to a longitudinal end of said major part to fold said minor part in a horizontal plane, said connector means including first and second connect members mounted on the each front portion of said major and minor parts, and a vertical axis located near the front edges of said sinker elements to joint the both connect members pivotally.

2. A collapsible flat bed knitting machine as claimed in claim 1, wherein said needle bed includes a central major part and two minor parts which are disposed in both sides of the central major part.

3. A collapsible flat bed knitting machine as claim in claim 2, wherein said central major part is half of said needle bed in length, and said two minor parts are respectively a quarter of said needle bed in length.

* * * * *